US009324309B2

(12) United States Patent
Piguet et al.

(10) Patent No.: US 9,324,309 B2
(45) Date of Patent: Apr. 26, 2016

(54) METHOD FOR ADJUSTING THE VIBRATION FREQUENCY RANGE OF A SOUND PRODUCING DEVICE WITH VIBRATING TONGUES

(71) Applicant: Montres Breguet SA, L'Abbaye (CH)

(72) Inventors: Rene Piguet, La Sarraz (CH); Benoit Junod, Peillonnex (FR); Polychronis Nakis Karapatis, Premier (CH); Sylvain Marechal, Bois-d'Amont (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/299,434

(22) Filed: Jun. 9, 2014

(65) Prior Publication Data

US 2014/0366705 A1 Dec. 18, 2014

(30) Foreign Application Priority Data

Jun. 14, 2013 (EP) ..... 13172119

(51) Int. Cl.
*G10F 1/06* (2006.01)
*G10H 3/12* (2006.01)

(52) U.S. Cl.
CPC ... *G10H 3/12* (2013.01); *G10F 1/06* (2013.01)

(58) Field of Classification Search
USPC ..... 84/94.1, 94.2, 95.1, 96, 101, 293, 363, 84/377, 378, 402, 408
See application file for complete search history.

(56) References Cited

U.S. PATENT DOCUMENTS 342,979 A 6/1886 Sueup
2,330,261 A * 9/1943 Beyer ..... 84/363
2,687,058 A * 8/1954 Obst ..... 84/377
2,755,697 A 7/1956 Miessner
2,838,834 A * 6/1958 Ganine ..... 29/896.22
3,013,460 A * 12/1961 Groux ..... 84/94.1
4,676,135 A * 6/1987 Kitazawa et al. ..... 84/94.1
5,973,240 A * 10/1999 Isaka ..... 84/97
6,239,336 B1 * 5/2001 Orii et al. ..... 84/95.1
6,268,554 B1 * 7/2001 Ashton ..... 84/95.2
2004/0065184 A1 * 4/2004 Isaka et al. ..... 84/94.1
2004/0123718 A1 * 7/2004 Muramatsu et al. ..... 84/94.1
2012/0192697 A1 * 8/2012 Favre ..... 84/95.1
2013/0036894 A1 * 2/2013 Bibollet ..... 84/378

FOREIGN PATENT DOCUMENTS

JP 2002-116753 4/2002
JP 2008-268827 11/2008

OTHER PUBLICATIONS

European Search Report issued Oct. 11, 2013, in European Application No. 13172119.3 filed Jun. 14, 2013 (with English Translation).

* cited by examiner

*Primary Examiner* — Christopher Uhlir
(74) *Attorney, Agent, or Firm* — Oblon, McClelland, Maier & Neustadt, L.L.P.

(57) ABSTRACT

The invention concerns a method for adjusting the vibration frequency range of a sound producing device with vibrating tongues. The device includes an assembly formed of a comb extended by at least one vibrating tongue, said comb having at least one hole for the securing thereof to a support by means of a support jaw and of a tightening element traversing the support jaw and the hole in the aforecited comb. According to the method, the frequency range is adjusted by reducing the free length of the vibrating tongue or tongues by the localized clamping of said tongues between the support jaw and a local counter-support.

13 Claims, 4 Drawing Sheets

METHOD FOR ADJUSTING THE VIBRATION FREQUENCY RANGE OF A SOUND PRODUCING DEVICE WITH VIBRATING TONGUES

This application claims priority from European Patent Application No. 13172119.3 filed 14.06.2013, the entire disclosure of which is incorporated herein by reference.

FIELD OF THE INVENTION

The invention relates to a method for adjusting the vibration frequency range of a sound producing device with one or more vibrating tongues or strips.

BACKGROUND OF THE INVENTION

The first musical box, created in 1796 by Antoine Fabre, was formed of a cylinder provided with pins and a set of tongues defined as a musical pin-barrel. When the cylinder rotates, the pins on the cylinder are arranged to lift and then release, in a well defined order, the steel tongues of the pin-barrel, which are perfectly tuned, to reproduce a tune. As they fall again, the tongues vibrate and thus each indirectly produce one sound from a melody to be played.

This type of musical box with the aforementioned sound producing device can be integrated in jewellery boxes or in toys or also in watches.

U.S. Pat. No. 2,755,697 may be cited in this regards, which discloses a tongue carried by a comb, which is clamped between a support piece and a clamp.

To adjust the acoustic frequency produced by the tongue, a load member can be added to said tongue. This load member is movable and, depending on the position of said load member along said tongue, the frequency and therefore the sound produced is modified.

U.S. Pat. No. 3,013,460 discloses a set of tongues connected by a common comb. The comb is immobilised on a base, where it is supported and held by a clamp using screws traversing the clamp and the comb. To tune the tongues, instead of adding a load member, the tongues are machined in order to remove material.

To secure this set of tongues of different lengths to a support or a base, a clamp is usually used, which is applied to the comb and which is held in place by screws, whose shafts traverse pierced holes in the clamp and the comb and each cooperate with a threaded sink, comprised in the support. The clamp only presses on the comb and the pierced holes are made to the diameter of the screw shafts with operating play.

In principal, the tongue lengths are calculated each to produce a determined frequency of a sound and no action is necessary in terms of an adjustment. However, as indicated above, it is possible to adjust the vibration frequency of each tongue by adding a load member to the tongue in U.S. Pat. No. 2,755,697 or by removing material in U.S. Pat. No. 3,013,460. This is then a fine adjustment.

The solution of U.S. Pat. No. 2,755,697, of adding a sliding load member, is difficult to implement in the case of a device for incorporation in a watch, due to the miniaturisation required. Further, it is unreliable, as it is difficult to secure the load member to the tongue, given than the vibrations tend to unscrew the screw securing the load member.

The solution set out in U.S. Pat. No. 3,013,460 is more reliable, but requires subjecting the pin-barrel to a further machining operation.

Beyond these fine adjustments, when it is desired to work in a different frequency range, another pin-barrel has to be produced with different tongue lengths. A pin-barrel having its own tongue lengths must thus be produced each time, which is a drawback.

SUMMARY OF THE INVENTION

The invention proposes to provide a solution to the aforementioned drawbacks of the state of the art.

The invention therefore relates to a method for adjusting the vibration frequency range of a sound producing device with one or more vibrating tongues, the device including an assembly formed of a comb extended by at least one vibrating tongue, said comb having at least one hole for the securing thereof to a support by means of a support jaw and a tightening element traversing the support jaw and the hole of the aforecited comb, said method being characterized in that the frequency range is adjusted by reducing the free length of the vibrating tongue or tongues by the localised clamping of the tongue or tongues between the support jaw and a local counter-support.

The invention also concerns means for implementing the adjustment method, the means including a sound producing device with one or more vibrating tongues, which includes an assembly formed of a comb extended by at least one vibrating tongue, said tongue has at least one hole for the securing thereof to a support by means of a support jaw and a tightening element traversing the support jaw and the aforecited hole of the jaw, these means being characterized in that they include means for reducing the free length of the vibrating tongue or tongues by the localised clamping of the tongue or tongues between the support jaw and a local counter-support.

One advantage of the sound producing device provided with means of adjusting the frequency range of the musical pin-barrel lies in the fact the general length of the vibrating tongue or tongues may easily be adjusted without having to change the pin-barrel. This makes it possible to adapt the frequency range, via at least one jaw fixed to a support, and via a counter-support, by locally clamping an end portion of the tongue or tongues, when the comb of the pin-barrel is secured to the support of the device. Thus, it is easily possible to create a standard pin-barrel while enabling the sounds generated by the tongues of the pin-barrel to be adapted for mounting, for example, in a watch.

Advantageously, these adjustment means of the sound producing device are also arranged to improve the securing of the pin-barrel with supports provided above and below the comb and on an end portion of the tongues. Thus, acoustic transmission to the radiating components of the watch is improved.

BRIEF DESCRIPTION OF THE DRAWINGS

The invention will be understood with the aid of the following description given by way of non-limiting example with reference to the drawings, in which.

DETAILED DESCRIPTION OF THE INVENTION

Figure 1:
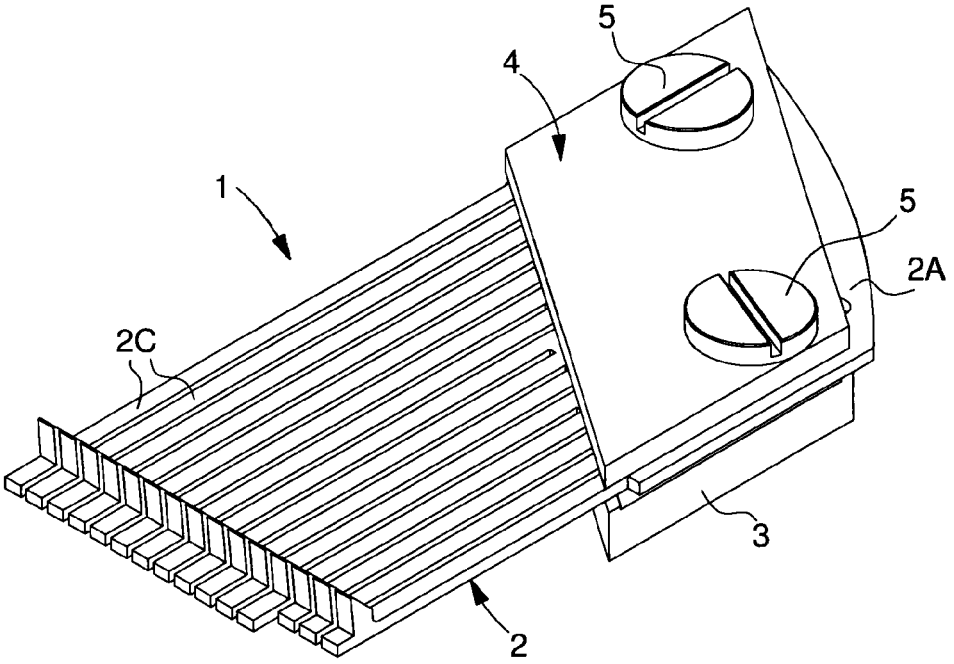
FIG. 1 shows a perspective view of a first embodiment of the sound producing device provided with means of adjusting the frequency range of the musical pin-barrel according to the invention.

Referring to the Figures above, a device 1 is shown with vibrating tongues for producing music including a set 2 of vibrating tongues 2C of different lengths to produce a range of sounds. Vibrating tongues 2C are all connected at one end to a comb 2A to form a comb-like structure. This set of tongues is also called a pin-barrel, whose tongues and comb are made in a single piece of material. It is, however, possible to envisage creating a single tongue connected at one end thereof to a securing comb.

A means (not shown) makes it possible to move and release the free ends of the tongues in a programmed manner to produce a melody. This means may be a drum or disc driven in rotation by a spring mechanism. The drum or disc carries lugs projecting onto the cylindrical surface of the drum or onto one of the faces of the disc. When the lug passes the end of the tongue, the cam-shaped end of the tongue is moved or raised and then abruptly dropped, which causes vibrations of each activated tongue.

Comb 2A connecting one of the ends of tongues 2C is provided with a hole 2B for supporting the comb on a support 3 or a base by a support jaw 4. Preferably, comb 2A includes at least two holes 2B for the securing thereof to support 3. This jaw 4 is supported on the comb and is secured by at least one tightening element 5 traversing jaw 4 and one of holes 2B of comb 2A. Preferably, at least two tightening elements 5 respectively passing through the two holes 2B of the comb are arranged to secure the comb to the support, clamped between one portion of jaw 4 and a surface of support 3. The tightening elements 5 may advantageously be screws, with the screw head pressing against a top surface of jaw 4 and the shaft passing through a corresponding aperture in the jaw before being screwed into an internal thread of support 3. The further each tightening screw is screwed into the internal thread of the support, the greater the clamping force applied to an end portion of tongues 2C of the pin-barrel, ensuring improved hold.

Support jaw 4 is formed by a rigid thick plate forming a clamp, which covers the comb and an end portion of the tongues connected to the comb. By securing jaw 4 to the support by sandwiching the comb and an end portion of the tongues, it is possible to adapt the active length of the tongues, which is one of the vibration parameters of each tongue of the pin-barrel.

Figure 2:
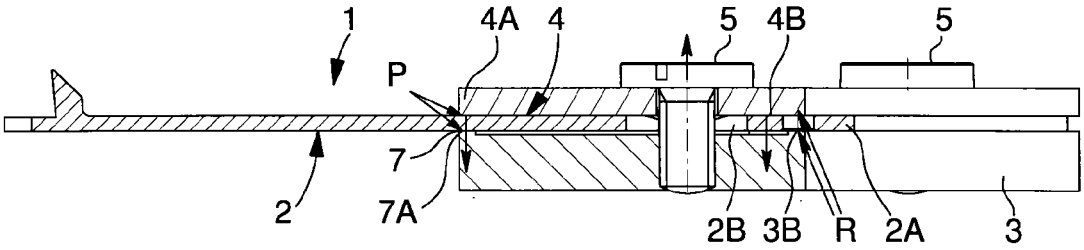
FIG. 2 shows a longitudinal cross-section of the sound producing device of FIG. 1.

To achieve this in an advantageous manner, it is possible to adjust the frequency range by reducing the free length of the vibrating tongue or tongues 2C by the localised clamping of said tongue between support jaw 4 and a local counter-support 7 as shown in FIG. 2. Clamping an end portion of tongues 2C between support jaw 4 and counter-support 7 of support 3 may be considered as increasing the comb securing the pin-barrel. Between the clamping at the first clamping points of FIG. 2 and second clamping points where the comb is positioned further back, the tongue or tongues will no longer vibrate. These clamped tongue portions will thus behave like the comb of the pin-barrel.

The new active region of the tongue or tongues is that located between the clamping at the first clamping points of FIG. 2 and the free end of each tongue, whereas according to the state of the art, the active region of each tongue starts at the point of juncture between each tongue and the comb.

With this localised clamping of the tongue or tongues of the pin-barrel, there is therefore created a new vibration node in clamping region P as shown in FIGS. 2, 4, 6 and 8. Means are therefore used to reduce the active or free length of each vibrating tongue by localised clamping between jaw 4 and, for example, a local counter-support 7, as shown in FIG. 2.

To achieve this, support jaw 4 and, at least indirectly, support 3 are configured to form a local clamping region P and the hole or holes 2B of the comb are elongated in the direction of the tongues to allow each tongue to move relative to local clamping region P. By pressing on each tongue 2C at a distance from comb 2A, a new vibrating tongue length will be defined, which is shorter than the original length, which was the distance between the comb and the free end of each tongue of the pin-barrel.

Support jaw 4 and counter-support 7 will thus lock comb 2A and an end portion of tongue or tongues 2C onto support 3. This end portion of the tongues, which is situated between the local clamping region and the comb, will therefore be immobilised and thus will no longer vibrate. The active length of the tongue or tongues therefore extends between the local clamping region and the free end of said tongues.

In order to adjust the active length of the tongue or tongues of the pin-barrel, the comb connected to the tongues is moved, particularly relative to support 3, to support jaw 4, and to counter-support 7, which forms fixed points. This movement of the pin-barrel is possible, because the hole or holes 2B of comb 2A are elongated along the longitudinal axis of the tongues. The further backwards the comb is moved, the shorter the active length of each tongue will be after the jaw has been secured to the support by the tightening screws. It is thus possible to modify the frequency or range of frequencies without removing or adding material to the tongue or tongues of the pin-barrel.

Support 3 and the means of securing the tongue or tongues, such as support jaw 4, are considered to be means having a fixed position. It is thus by moving the comb and thereby the tongue or tongues, that the sound producing device is adjusted.

Several embodiments of the sound producing device provided with means of adjusting the frequency range of the musical pin-barrel will be described below.

In a first embodiment of FIGS. 1 and 2, partly described above, counter-support 7 is directly formed by support 3, which has a rib 7A on the front edge thereof and the front edge of jaw 4 also has a rib 4A, which is positioned facing rib 7A of the support to form a clamp. This clamp defines first clamping points on an end portion of the tongue or tongues of the pin-barrel.

To improve tightening, the back edge of support 3 and the back edge of jaw 4 also have a rib 3B, 4B respectively, which are positioned facing each other. Thus, comb 2A and the tongue or tongues 2C are in contact with the support and the jaw only on the ribs, so that the force exerted by the screw on jaw 4 is converted into localised clamping pressure on the tongue and on the comb. This pressure is concentrated on the clamping regions.

Figure 3:
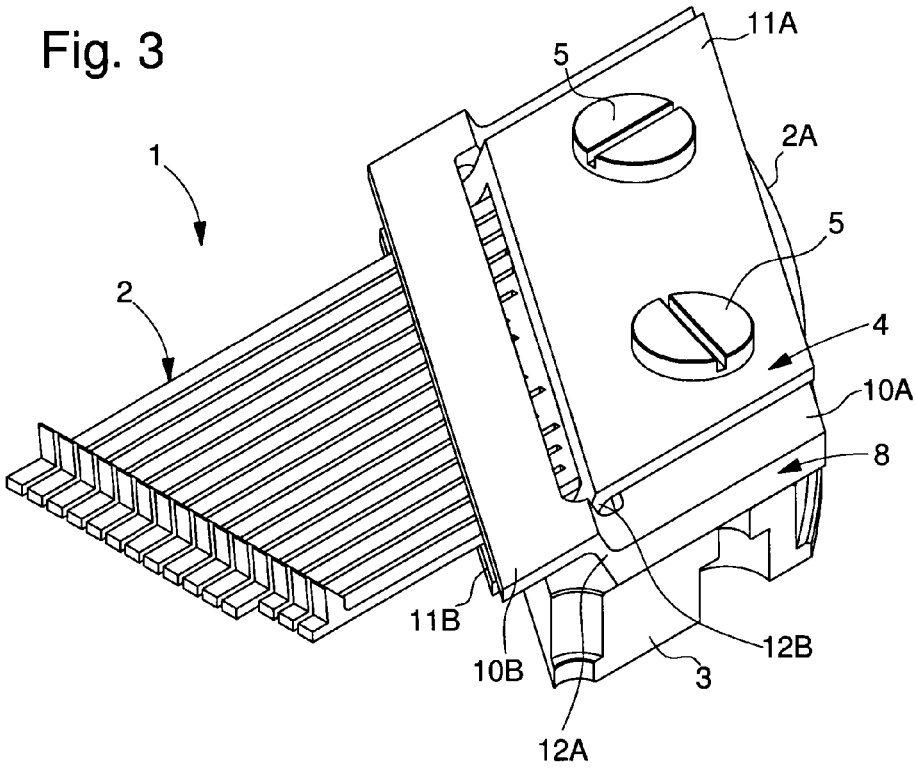
FIG. 3 shows a perspective view of a second embodiment of the sound producing device provided with means of adjusting the frequency range of the musical pin-barrel according to the invention.
Figure 4:
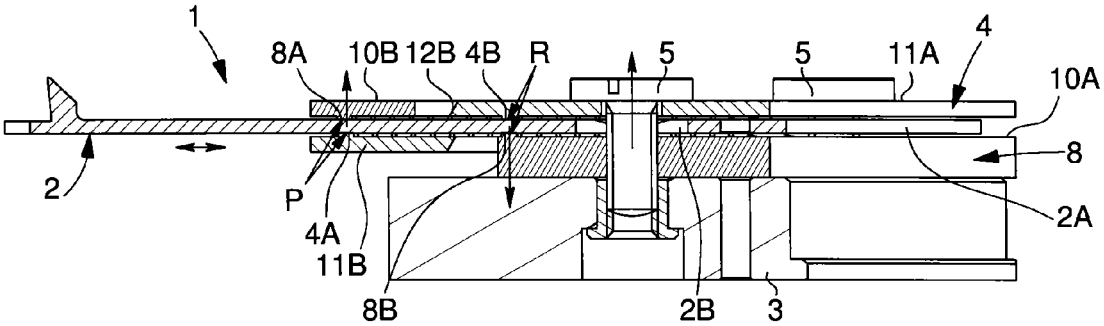
FIG. 4 shows a longitudinal cross-section of the sound producing device of FIG. 3.

In a second embodiment shown in FIGS. 3 and 4, the counter-support is comprised in a part 8 independent of support 3, which thus forms a second jaw 8 or counter-support jaw. According to this embodiment, the two parts forming jaws 4, 8 are adapted to intersect in the manner of a pair of crossed scissors.

Each jaw 4, 8 includes two plates 10A, 10B, 11A and 11B, which are situated in two substantially parallel planes and are joined by a cross-shaped member 12A, 12B, one of which is a first loop 12A and the other is a second inclined loop 12B. This second inclined loop 12B is inserted into the first loop 12A. The pin-barrel tongues pass between the first and second loops. The plates have ribs facing each other to form a front clamping region P and a back clamping region R. Front clamping region P is arranged to clamp an end portion of the pin-barrel tongues, in order to adjust the frequency range of said pin-barrel. Clamping region P may be defined as the first clamping points, whereas the back clamping region R on the comb may be defined as the second clamping points.

Clamping region R is formed by one of the pairs of ribs 4B, 8B, which are positioned between the back and the intersection of the parts, the other pair 4A, 8A of ribs of clamping region P are located after the cross-shaped members as far as possible therefrom. It may be assumed that ribs 4B, 8B, which are the closest to tightening screws 5 and thus behind the cross-shaped members, act as a pivot line.

One of the two arms of the scissors 10*a* is supported on support 3 and has a jaw 10B, which is above the tongues of pin-barrel 2, whereas the other arm is above the comb and its jaw is under the tongues.

In the first embodiment of FIGS. 1 and 2, described above, only the free length of the tongues overhangs in relation to support 3. However, for this second embodiment of FIGS. 3 and 4, the tongue clamping region P overhangs in relation to said support. Preferably, second jaw 8, which is supported on support 3, is dimensioned to be more rigid than the first jaw 4.

The lever effect obtained is greater or lesser depending on the position of the pairs of ribs 4A, 8A and 4B, 8B in relation to tightening screws 5 and to the position of the axis of rotation of the pair of scissors. According to this solution, the axis of rotation is formed by the pair of ribs 4B, 8B, located beyond the region where jaws 4, 8 cross.

Figure 5:
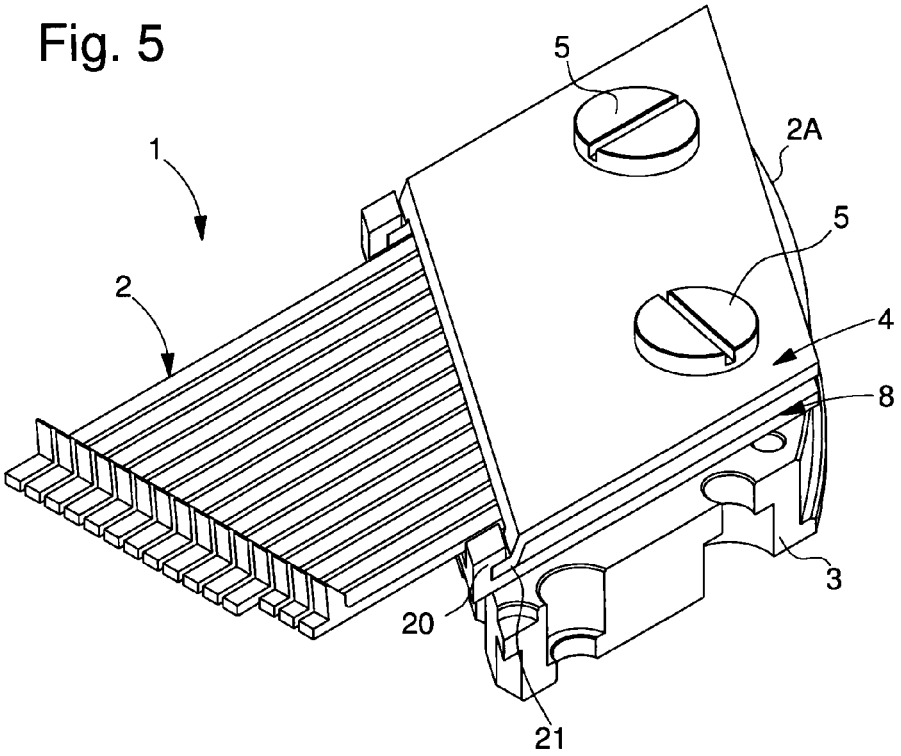
FIG. 5 shows a perspective view of a third embodiment of the sound producing device provided with means of adjusting the frequency range of the musical pin-barrel according to the invention.
Figure 6:
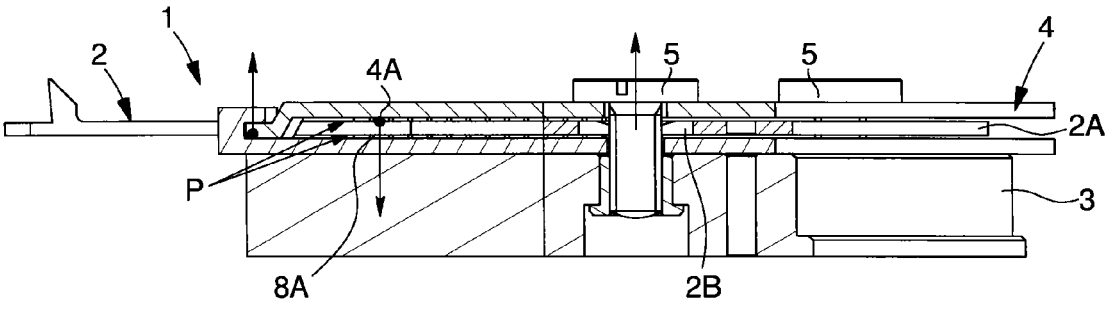
FIG. 6 shows a longitudinal cross-section of the sound producing device of FIG. 5.

A third embodiment of the sound producing device is shown in FIGS. 5 and 6. This time, the two jaws 4, 8 cooperate at their distal ends forming a sort of pivot. Behind the pivot, each jaw has a rib 4A, 8A defining clamping region P. Thus, tightening the tightening screw or screws 5 moves ribs 4A, 8A of the pin-barrel tongue or tongues closer together.

For forming the pivot line, there are several possibilities. More specifically, on its two lateral sides towards the front, the second jaw 8, which forms a counter-support, carries hooks 20 open towards the back of the jaw. Two lugs 21 of the front edge of first jaw 4 are inserted into these hooks 20 to form the pivot. The two jaws 4 and 8 are wider than the set of vibrating tongues of the pin-barrel. Further, the assembly of the pivots leaves an aperture open for the passage of the tongues.

Figure 7:
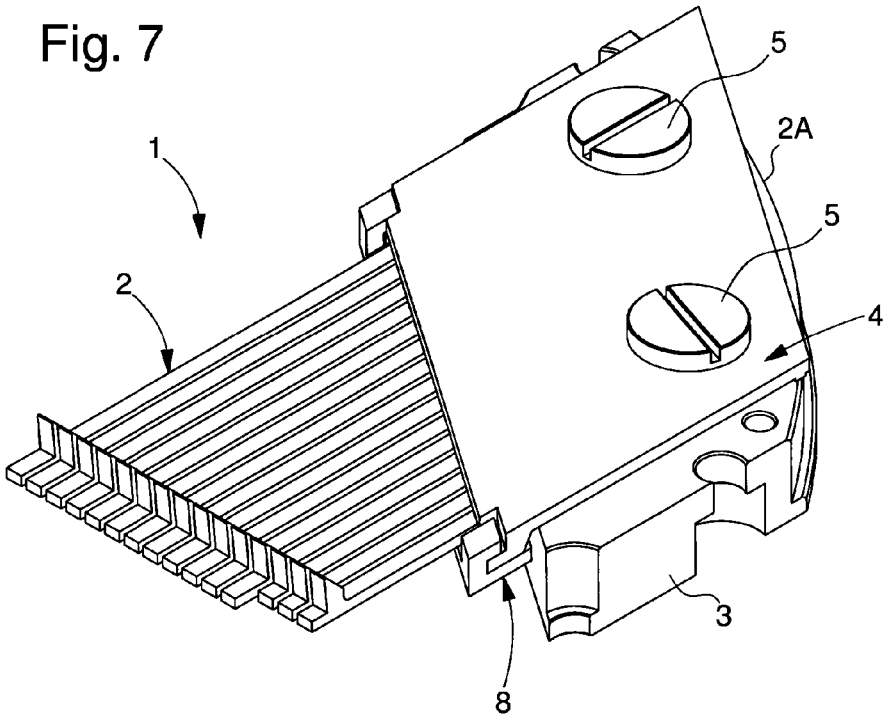
FIG. 7 shows a perspective view of a fourth embodiment of the sound producing device provided with means of adjusting the frequency range of the pin-barrel according to the invention.
Figure 8:
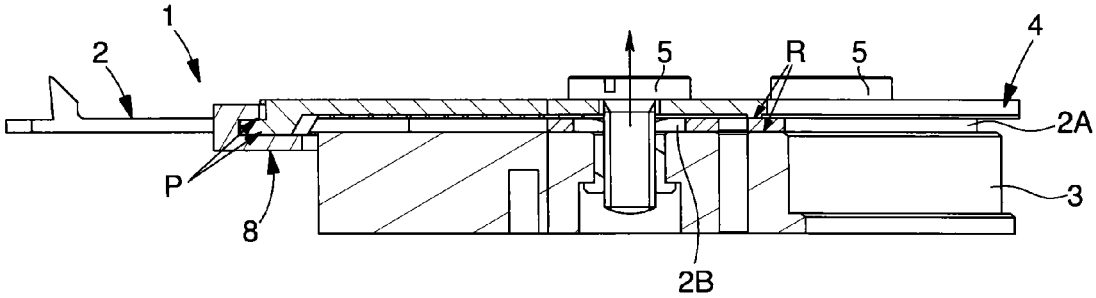
FIG. 8 shows a longitudinal cross-section of the sound producing device of FIG. 7.

A fourth embodiment of the sound producing device is shown in FIGS. 7 and 8. In this embodiment, a cross-piece 8 forming a counter-support is fixed to the distal end of support jaw 4. Jaw 4 is also fixed to support 3. The part or cross-piece 8 is rigidly fixed to jaw 4, for example by elastic locking or tightening with screws which are not shown.

The means of securing cross-piece 8 to jaw 4 are able to move the cross-piece towards jaw 4 to clamp an end portion of the tongues. The principle of these securing means is thus to clamp the tongues at a distance from the comb so as to artificially elongate the comb and to reduce the free length of the tongues. It is thereby possible to modify the resonant frequency of each free tongue.

From the description that has just been given, those skilled in the art can devise several variants of the sound producing device provided with means of adjusting the frequency range of the musical pin-barrel without departing from the scope of the invention defined by the claims. It is possible to obtain selective clamping on certain tongues of the pin-barrel and not all the tongues of the pin-barrel to partially modify the frequency range of the musical pin-barrel. Two distinct means of adjusting the frequency range of the pin-barrel tongues may be provided, fixed, for example, on the same support.

What is claimed is:

1. A method for adjusting a vibration frequency range of a sound producing device with one or more vibrating tongues, the sound producing device including an assembly formed of a comb extended by at least one vibrating tongue, said comb including at least one hole to secure thereof to a support by a support jaw and a tightening element that traverses the support jaw and the at least one hole of said comb, the method comprising:

adjusting the vibration frequency range by reducing a free length of the vibrating tongue or tongues by localized clamping of the tongue or tongues between the support jaw and a local counter-support, wherein the at least one hole is shaped elongated along a direction of a length of the tongue or tongues to provide a movement of the assembly in relation to a region of the localized clamping, and the support jaw and the local counter-support form two jaws that are shaped to intersect in a manner of a pair of crossed scissors.

2. A sound producing device, comprising:

one or more vibrating tongues, an assembly formed of a comb extended by at least one of the one or more vibrating tongues, said comb including at least one hole to secure thereof to a support by a support jaw and a tightening element that traverses the support jaw and the hole of said comb, and a mechanism to reduce a free length of the vibrating tongue or tongues by localized clamping of the tongue or tongues between the support jaw and a local counter-support, wherein the at least one hole is shaped elongated along a direction of a length of the tongue or tongues to provide a movement of the assembly in relation to a region of the localized clamping, and the support jaw and the local counter-support form two jaws that are shaped to intersect in a manner of a pair of crossed scissors.

3. The sound producing device according to claim 2, wherein the support jaw and the support are arranged to form the localized clamping region of the tongue or tongues.

4. The sound producing device according to claim 3, wherein the support includes a first rib on a front edge, and wherein a front edge of the support jaw includes a second rib, which is positioned facing the first rib of the support to form a clamp.

5. The sound producing device according to claim 4, wherein a back edge of the support and a back edge of the support jaw also include other ribs positioned facing each other.

6. The sound producing device according to claim 2, wherein the local counter-support is defined by a part independent of the support to form a second counter-support jaw.

7. The sound producing device according to claim 2, wherein the two jaws are defined as two plates, which are situated in two substantially parallel planes and are joined by a cross-shaped member, one of which is formed by a first loop and the other by a second inclined loop inserted into said first loop, and wherein the plates include ribs facing each other to form a front clamping region of the tongues and a back clamping region.

8. The sound producing device according to claim 6, wherein the two jaws cooperate at distal ends thereof to form at said ends a pivot, and wherein behind the pivot, each jaw includes a rib defining a clamping region.

9. The sound producing device according to claim 8, wherein, on two lateral sides thereof towards a front, the second counter-support jaw includes hooks open towards a back of the second counter-support jaw, into which two lugs of a front edge of the support jaw are inserted to form the pivot.

10. The sound producing device according to claim 6, wherein the local counter-support is formed by a cross-piece fixed to the support jaw by a securing structure, said securing structure configured to move the cross-piece towards the support jaw to clamp the tongue or tongues.

11. The sound producing device according to claim 6, wherein the local counter-support is formed by a cross-piece fixed to the support jaw by means for securing, said securing means configured to move the cross-piece towards the support jaw to clamp the tongue or tongues.

12. A method for adjusting a vibration frequency range of a sound producing device with one or more vibrating tongues, the sound producing device including an assembly formed of a comb extended by at least one vibrating tongue, said comb including at least one hole to secure thereof to a support by a support jaw and a tightening element that traverses the support jaw and the at least one hole of said comb, the method comprising:

adjusting the vibration frequency range by reducing a free length of the vibrating tongue or tongues by localized clamping of the tongue or tongues between the support jaw and a local counter-support, wherein the at least one hole is shaped elongated along a direction of a length of the tongue or tongues to provide a movement of the assembly in relation to a region of the localized clamping, and the support jaw and the local counter-support form two jaws that cooperate at distal ends thereof to form at said ends a pivot, and behind the pivot, each jaw includes a rib defining a clamping region.

13. The method according to claim 12, wherein, on two lateral sides thereof towards a front, the local counter-support includes hooks open towards a back of the local counter-support, into which two lugs of a front edge of the support jaw are inserted to form the pivot.

* * * * *